United States Patent [19]

Wilson

[11] Patent Number: 4,808,126

[45] Date of Patent: Feb. 28, 1989

[54] ELECTRICAL CONNECTOR SHIELD

[75] Inventor: Albert H. Wilson, Los Angeles, Calif.

[73] Assignee: ITT Corporation, New York, N.Y.

[21] Appl. No.: 104,714

[22] Filed: Oct. 5, 1987

[51] Int. Cl.[4] ..... H01R 4/66

[52] U.S. Cl. ..... 439/607

[58] Field of Search ..... 174/35 GC; 339/607-610

[56] References Cited

U.S. PATENT DOCUMENTS

| | | | |
|---|---|---|---|
| 4,098,633 | 7/1978 | Kersten | 174/35 GC |
| 4,239,318 | 12/1980 | Schwartz | 439/609 |
| 4,243,290 | 1/1981 | Williams | 339/143 |
| 4,248,492 | 2/1981 | Snyder | 339/89 |
| 4,326,768 | 4/1982 | Punaku | 439/609 |
| 4,330,166 | 5/1982 | Cooper | 339/143 |
| 4,349,241 | 9/1982 | Juris et al. | 339/143 |
| 4,441,780 | 4/1984 | Walters | 339/143 |
| 4,470,657 | 9/1984 | Deacon | 339/143 |
| 4,512,623 | 4/1985 | Tomsa | 339/143 |
| 4,516,815 | 5/1985 | Venable et al. | 339/14 |
| 4,529,257 | 7/1985 | Goodman et al. | 439/607 |
| 4,544,227 | 10/1985 | Hirose | 339/143 |
| 4,583,809 | 4/1986 | Werth et al. | 339/143 |

FOREIGN PATENT DOCUMENTS

| | | | |
|---|---|---|---|
| 571940 | 9/1977 | U.S.S.R. | 174/35 GC |

OTHER PUBLICATIONS

IBM Technical Disclosure Bulletin, vol. 20, No. 1, 6/1977, "Conductive Seal for Electromagnetic Shielding"; Nuccio et al.

*Primary Examiner*—Joseph H. McGlynn

*Attorney, Agent, or Firm*—Thomas L. Peterson

[57] ABSTRACT

An EMI/RFI shield is disclosed in which the shield is mounted in a continuous groove formed about the outside surface of the connector plug. The shield comprises a metal spring which is mounted over the outside of an elastomeric backup ring. Marginal portions of the spring are wrapped around the side edges of the ring so that the spring will pipe along sidewalls of the groove when the plug is mated with the receptacle, thereby enhancing the electrical connection between the plug and receptacle shells, and increasing shielding effectiveness.

23 Claims, 3 Drawing Sheets

FIG. 1
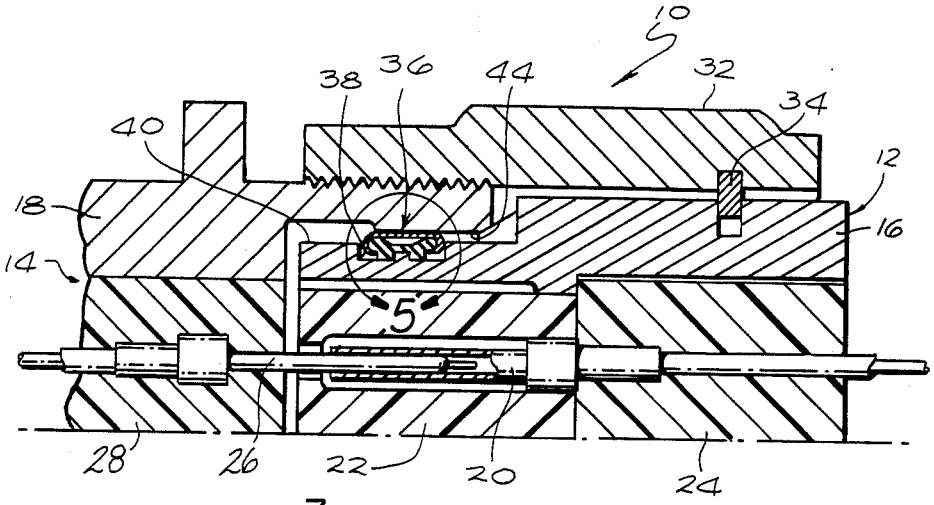
FIG. 2
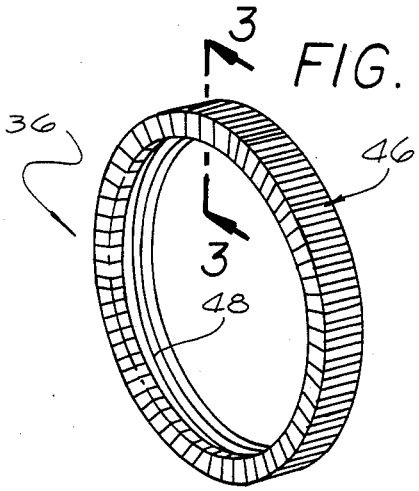
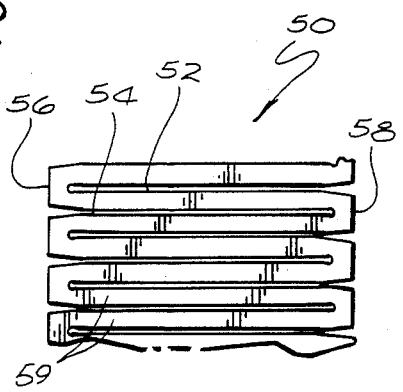
FIG. 4
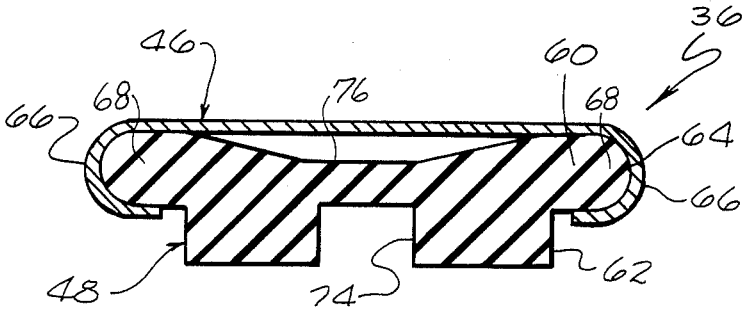
FIG. 3

ELECTRICAL CONNECTOR SHIELD

BACKGROUND OF THE INVENTION

The present invention relates generally to an electrical connector and, more particularly, to a electro-magnetic and radio frequency interference (EMI/RFI) shield for an electrical connector.

The use of a shield in an electrical connector to eliminate RFI and EMI from interfering with signals being carried by the contacts in connectors is well known. U.S. Pat. Nos. 3,521,222; 3,678,445; 4,106,839, 4,239,318 and 4,326,768 disclose annular shields formed of sheet metal with resilient fingers which electrically engage the outer surface of the plug shell and the inner surface of the receptacle shell of the electrical connector.

A newly proposed U.S. Government specification requires for EMI/FRI shielding of an electrical connector to be in the range of 85–90 dB shielding effectiveness. A common EMI/RFI shield that has been used in the past to meet prior Government specifications is similar to that disclosed in the aforementioned U.S. Pat. No. 4,106,839. The shield comprises a stamped and formed metal spring in which fingers extending laterally from an annular band are reversely folded with the outer ends of the fingers resiliently engaging the inside surface of the receptacle shell. The shield is secured to the plug of the connector by forming the band with a U-shaped cross-section which fits tightly over an upstanding annular flange on the plug shell. Such a shield is not satisfactory for meeting the aforementioned specification because of certain design constraints imposed upon the connector. First, the mating force requirements for the plug and receptacle are so low that the normal force of the spring fingers of the shield must be very low, which reduces the conductance of the spring fingers. Second, because of the requirement to use cadmium plating and an outer chromate coating for environmental protection of the connector, the normal force of the shield spring fingers is not enough to break through the chromate coating, thus creating a capacitor effect between the plug and receptacle. Third, the vibration test requirements for the specification are quite severe. During vibration testing, it has been found that the spring fingers of the prior art shield are overstressed and break. The length of the spring fingers have been made longer to reduce the fatigue stress on the fingers. However, this in turn lowers the normal force even more between the spring fingers and the receptacle shell. Finally, the aforementioned shield has been found to have a shielding effectiveness of only about 35 dB. For the foregoing reasons, the prior art shield will not meet the aforementioned specification.

The aforementioned U.S. Pat. Nos. 4,239,318 and 4,326,768 each discloses an EMI/RFI shield which is in the form of a spring band that is lanced to provide alternating slits which open at opposite edges of the band. Thus, the band has a generally serpentine configuration which is capable of being expanded over the plug shell of the connector. While this form of shield has reduced inductance as compared to the folded spring finger shield of the type disclosed in the aforementioned U.S. Pat. No. 4,106,839, the required normal force of the shield to meet the requirements of the above mentioned Government specification is too great to avoid fatigue failure of the spring material.

U.S. Pat. No. 4,529,259 discloses a combined electrical shield and environmental seal for an electrical connector in which a coil spring is embedded in a central portion of an elastomeric ring. The ring has enlarged portions on opposite sides of the coil spring which serve as environmental seals. The elastomeric ring is relatively soft so that the coil spring constitutes the principal spring member of the composite element. Such a shield does not meet the requirements set forth above, because the high stresses in the spring generated during vibration cause it to fail in fatigue.

U.S. Pat. No. 3,998,512 discloses a connecting device for a digital wristwatch, which is of some interest with respect to the present invention inasmuch as it discloses an elastomeric backup ring for conductors. However, the conductors are in the form of metallic coatings on the surface of an elastomeric strip, which is interposed between the display panel and logic circuit used in the wristwatch. In such application, where miniaturization is critical and only low forces are required, the elastomeric strip undergoes only slight compression. Such a connecting device is totally unsuitable for EMI/RFI shielding where relatively high spring forces are required, which would necessitate substantial compression of the elastomeric strip, that in turn would cause the conductive coating on the strip to become cracked, thereby greatly impairing if not totally destroying the electrical connection between the conductors interconnected by the device.

Accordingly, which is needed and constitutes the principal object of the present invention is an improved EMI/RFI shield which achieves adequate spring force to meet high shielding effectiveness requirements, produces an effective electrical connection between the plug and receptacle shells of a connector even when subjected to high vibration, and yet avoids over stressing of the spring elements of the shield.

SUMMARY OF THE INVENTION

According to a principal aspect of the present invention, there is provided an EMI/RFI shield for an electrical connector which is mounted in a groove in one of the connector shells, normally the plug shell. The shield comprises a spring which is mounted over an elastomeric backup ring. Preferably, the shield has interference fit in the groove so that the spring is bowed outwardly for engagement with the inside surface of the receptacle shell when the plug and the receptacle are mated. The marginal portions of the spring are bent down over the side edges of the elastomeric ring so that when the plug and receptacle are mated, such marginal portions have a strong wiping engagement against the sidewalls of the groove, thereby providing a very effective electrical connection between the shells of the plug and receptacle. The elastomeric ring comprises the major spring element of the shield assembly. The ring provides a strong resilient force behind the metallic spring when compressed which assures a high normal force between the spring and the inside surface of the receptacle shell, and allows minimal flexing of the metal spring. It also pushes the spring outwardly from the bottom region of the groove when the plug and receptacle are disengaged.

Other objects, aspects and advantages of the invention will become apparent from the following description taken in connection with the accompanying drawings.

BRIEF DESCRIPTION OF THE DRAWINGS

FIG. 1 is a partial longitudinal sectional view through an electrical connector, shown in its fully mated condition, embodying one form of the EMI/RFI shield of the present invention;

FIG. 2 is a perspective view of the shield illustrated in FIG. 1;

FIG. 3 is an enlarged transverse sectional view taken along line 3—3 of FIG. 2 showing the cross-section of the shield;

FIG. 4 is a fragmentary top plan view of the spring used in the shield of the present invention;

FIGS. 9 and 10 are sectional views similar to FIG. 5 to 6, showing still a further alternative form of the shield of the present inventin; and FIGS. 11 and 12 are similar to FIG. 6 showing still two additional embodiments of the shield of the invention.

DESCRIPTION OF THE PREFERRED EMBODIMENTS

Figure 5:
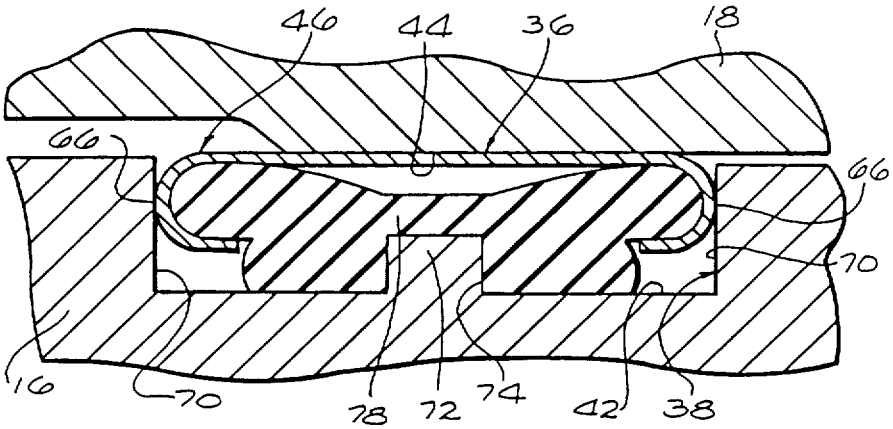
FIG. 5 is an enlarged cross-sectional view of the area delineated by 5—5 of FIG. 1 showing the condition of the shield when the plug and receptacle are mated.

Referring now to the drawings in detail, there is illustrated in FIG. 1 the preferred embodiment of the connector of the present invention, generally designated 10, comprising a plug 12 and a receptacle 14. The plug comprises a cylindrical shell 16 which is telescopically mounted within the front end of the cylindrical shell 18 of the receptacle. A plurality of socket contacts 20 are axially positioned in insulators 22 and 24 mounted in the shell 16. Each contact 20 receives a pin contact 26 which is mounted in an insulator 28 in the receptacle 14. A coupling nut 32 is retained on the shell 16 of the plug by retaining ring 34. The forward end of the coupling nut is threadadly engaged with the shell 18 of the receptacle.

The EMI/RFI shield of the present invention, generally designated 36, is mounted in an annular groove 38 formed in the outer cylindrical surface 40 of the shell 16. Alternatively, the groove could be formed in the inner surface of the receptacle shell 18. The bottom 42 of the groove provides a cylindrical surface which faces the inner cylindrical surface 44 of the receptacle shell 18.

As best see in FIG. 2, the shield 36 is a composite, comprising a spring 46 and an elastomeric backup ring 48. The spring comprises a sheet metal band 50, formed of beryllium copper or the like, which is lanced to provide alternating slits 52 and 54 that extend to the opposite side edges 56 and 58 of the band. The slits define a plurality of spring fingers 59. When the metal band 50 is mounted around the outside of the elastomeric ring 48, it will form an expandable metal shield similar to that disclosed in the aforementioned U.S. Pat. Nos. 4,239,318 and 4,326,768.

As best seen in FIG. 3, the ring 48, which may be formed of a flurosilicone or the like, comprises a relatively wide outer portion 60 and a relatively narrow inner portion 62. The spring 46 is wrapped around the outer periphery 64 of the ring 48. The marginal portions 66 of the spring are bent or wrapped around the side portions 68 of the wide outer portion of the ring 48 to secure the spring to the ring. As will be seen later, the marginal portions 66 of the spring will engage the sidewalls 70 of the groove 38 in the plug shell. The ends of the spring 46 are preferably secured together, in order to avoid separation of the ends of the spring on the elastomeric ring 48, by soldering, welding or the use of a metal clip (not shown).

Figure 6:
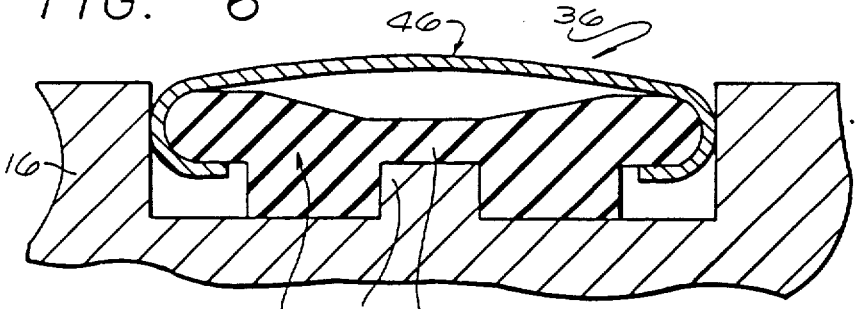
FIG. 6 is a sectional view similar to FIG. 5 showing the shield mounted on the plug shell, with the receptacle removed therefrom.

Preferably, the width of the shield 36 is slightly greater than the width of the groove 30 so that the shield will have an interference fit in the groove, causing the spring 46 to bow outwardly beyond the outer surface 40 of the plug shell, as best seen in FIG. 6.

In order to firmly secure the shield 36 in the groove 38, an upstanding annular flange 72 is formed in the groove 38 between the sidewalls 70. The flange extends tightly into an annular channel 74 formed in the inner surface of the elastomeric ring 48.

FIG. 5 shows the condition of the shield 36 after the plug and receptacle have been mated. During engagement of the plug and receptacle the shield is forced inwardly into the groove 38, and is radially compressed. This causes the narrow inner portion 62 of the ring 48, which extends below the marginal portions 66 of the spring 46, to be radially compressed which results in the sidewalls of the narrow portion 62 bulging outwardly slightly as seen in FIG. 5. Also, the wide outer portion 66 of the ring is displaced laterally to press the marginal portions 66 of the spring against the sidewalls of the groove thereby increasing the normal force between the spring of the shield and the plug shell 16. This results in the marginal portions 66 of the spring 46 having a strong wiping engagement with sidewalls 70 of the groove thereby providing a very good electrical connection between the shield and the plug. Also, during engagement of the plug and receptacle, the bowed spring 46 flattens causing the side edges of the spring to wrap further around the outer portion 60 of the ring 48, as seen in FIG. 5.

Due to the radial compression of the inner portion of ring 62, there is a strong engagement between the spring and the inner surface of receptacle shell 18 providing a good electrical connection therebetween. During mating of the plug and receptacle, there is a strong wiping engagement between the sides of the spring 46 and the sidewalls of the groove 38, and also between the bowed outer portion of the spring and the inside surface 44 of the receptacle shell 18. The wiping action provides a clean mating surface each time the plug and receptacle are mated.

When the plug and receptacle are unmated, the elastomeric ring 48 pushes the spring back up to its normal position illustrated in FIG. 6, thereby eliminating the "oil can" effect on the metal spring. The elastomeric ring also serves as a dampener during vibration, reducing fatigue stress on the spring. Further, by use of the elastomeric backup ring, heat treatment of the spring 46 is not required.

Further, by the present invention, a relatively short current path is provided between the connection of the spring 46 with the sidewalls 70 of the groove in plug shell 16, and the regions of the spring that engage the inner surface 44 of the receptacle shell 18, which reduces inductance, a contributor to poor EMI shielding effectiveness.

The shield 36 of the present invention has the additional advantage that the spring 46 has low inductance between the adjacent spring fingers 59. Further, the spring is not subjected to excessive stresses, as may occur to reversely folded spring fingers of the prior art shield, because the major spring element in the composite shield 36 is the elastomeric ring 48. Preferably the elastomer of the ring has a durometer of about 40 while the thickness of the metal spring may be about 0.006 inch. These figures are given by way of example only, and not by limitation.

On occasions, it is possible that when the plug and receptacle are mated, when the receptacle shell 18 first slides over the left side portion 68 of the shield 36, the right side portion of the shield might pop out of the groove 38. To prevent this from occurring, preferably an annular recess 76 is formed in the outer periphery 64 of the elastomeric ring 48, thereby providing a relatively thin section 78 of the elastomer between the two sides of the ring on the opposite sides of the flange 72. By this relatively thin section 78, the two side portions 68 of the ring are capable of operating virtually independent of each other so that when a radially inwardly directed force is applied to the left side portion 68 of the ring by the receptacle shell 18, that force will not be imparted to the opposite side of the ring causing it to pop out of the groove.

It has been found that a shield in accordance to the present invention as described hereinabove can achieve a shielding effectiveness of about 100 to 108 dB, thereby greatly exceeding the shielding effectiveness of shields utilizing folded spring fingers, and further exceeding the shielding requirements of the aforementioned Government specification.

Figure 7:
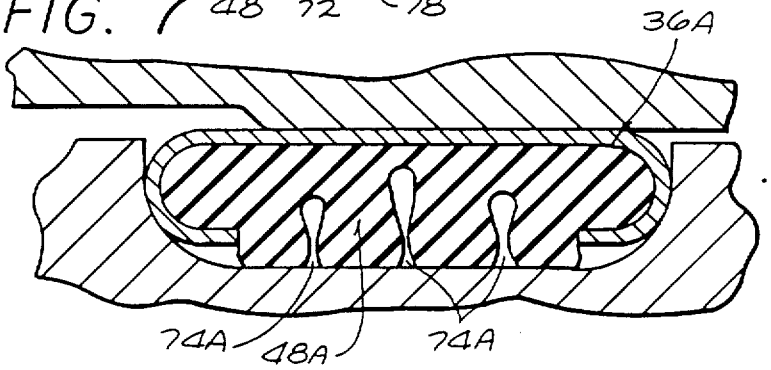
FIGS. 7 and 8 are sectional views similar to FIGS. 5 and 6, showing an alternative form of the shield of the present invention.
Figure 8:
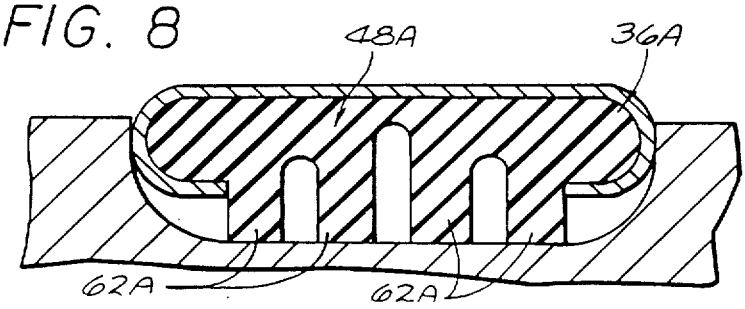

FIGS. 7 and 8 show an alternative form of the shield of the present invention, generally designated **36*a*. This shield is similar to the shield 36 except that the elastomeric ring 48*a* is formed with three annular channels 74*a* that open at the inside surface of the ring, forming relatively narrow elastomeric ribs 62*a*, which deform, as seen in FIG. 7**, when the plug and receptacle shells are mated.

A further form of the invention is illustrated in FIGS. 9 and 10 in which the elastomeric ring **48*b* is formed with relatively wide channels 74*b* and 76*b* in its lower and upper surfaces respectively. In contrast to the shields 36 and 36*a* described hereinbefore, in this embodiment the spring 46*b* is formed so that its marginal portions 66*b* simply extend vertically down along the vertical sidewalls of the elastomeric ring, rather than being wrapped around the side portions of the ring to secure the spring thereto. Preferably an adhesive is provided between the outer periphery regions 64*b* of the elastomeric ring and the spring 46*b* to retain the parts assembled to each other. Further, an adhesive may be used to secure the inner surface of the ring to the bottom of the groove 38*b***.

In the embodiment illustrated in FIG. 11, marginal portions **66*c* of the spring 46*c* extend down along the sidewalls of the elastomeric ring 48*c* similar to that described above in connection with FIGS. 9 and 10. Again, an adhesive is used to secure the spring to the ring. The bottom of the groove 38*c* is formed with an upstanding annular section 72*c* which supports the central region of the ring 48*c***, but allows the side portions of the ring to be compressed downwardly into the groove upon mating with the receptacle shell.

In FIG. 12, the elastomeric ring **48*d* is formed with two or more spaced annular recesses 76*d* in its outer periphery and two or more sets of annular recesses 74*d* in its inner periphery. The marginal portion 66*d* of one side of the spring is wrapped around the side portion 68*d*** on the corresponding side of the ring to secure the spring to the ring.

The use of the serpentine, watch spring type of spring 46 used with the shield of the present invention has the advantage that it may be secured to the backup ring 48, by bending over the marginal portions 66 of the spring, to provide a composite assembly prior to installation in the groove 38, since both the elastomeric ring and the spring may be expanded to fit the shield 36 over the plug shell for mounting in the groove. However, if the the marginal portions of the spring are not to be wrapped around the side portions of the elastomeric ring, but simply extend vertically downwardly, as in the embodiment illustrated in FIGS. 9 and 10, the spring could take another form, such as a bowed metal band (not shown) formed with slots therearound, which are spaced at their opposite ends from the sides of the band. Because such a spring would not be radially expandable with its ends secured, in such case the elastomeric ring could be initially mounted in the groove in the plug shell, and then the band could be fit around the ring and the two free ends of the band secured by welding or the like.

While the EMI/RFI shield of the present invention has been specifically described and illustrated herein as being in a circular form, it will be appreciated that the shield could assume other shapes depending upon the configuration of the connector. For example, the shield could be mounted in a "rectangular" connector in which the element would assume the configuration of the rectangular shells of the connector. Thus, the term "ring" as used herein is intended to embrace loop structures of any configuration, including circular, rectangular, "D" shaped, etc.

While the shield of the present invention has been characterized herein as providing EMI/RFI shielding, it will be appreciated that the extent of shielding will be dependent upon the wave length of the interfering signals and the size of the gaps existing between the fingers of the spring. In some applications of the invention the shield may function simply as a ground connection, rather than an effective shield. Accordingly, it is intended that the present invention embrace devices which may function as either effective shields and ground connections, or only as grounding connections. Thus, the term "electrical connecting element" recited in the appended claims is intended to cover a device used for either or both functions.

What is claimed is:

1. In combination, mating male and female shells having opposed surfaces when mated with an electrical connecting element between said surfaces, said connecting element comprising:

a substantially closed loop elastomeric member mounted in a continuous groove formed in one of said surfaces, said groove having a bottom and opposite side wall;

a metallic spring mounted around the surface of said elastomeric member opposite to said bottom of said groove;

said spring having marginal portions extending over the sides of said elastomeric member adjacent to said sidewalls, said marginal portions being spaced from said bottom of said groove; and said elastomeric member directly engaging said bottom of said groove and being compressed when said shells are mated causing said spring marginal portions to slidably engage said groove sidewalls.

2. The combination of claim 1 wherein:

said connecting element has an interference fit in said groove causing said spring to be bowed outwardly before said shells are mated.

3. The combination of claim 1 wherein:

said elastomeric member has a relatively wide portion over which said spring is mounted, and a relatively narrow portion extending from the marginal portions of said spring to said bottom of said groove.

4. The combination of claim 1 wherein:

said elastomeric member comprises the principal spring means of said connecting element whereby the fatigue strength of said metallic spring will not be exceeded.

5. An electrical connector comprising:

first and second mating connector members having spaced peripheral surfaces thereon facing each other when said connector members are mated, said peripheral surfaces surrounding the center axis of said connector members;

a continuous groove formed about one of said peripheral surfaces, said groove having a bottom and spaced sidewalls;

electrical connecting means mounted in said groove, said connecting means comprising a substantially closed loop elastomeric member and a metallic spring;

said metallic spring being mounted around the surface of said elastomeric member opposite to said bottom of said groove;

said spring having marginal portions extending over the sides of said elastomeric member adjacent to said sidewalls, said marginal portions being spaced from said bottom of said groove; and said elastomeric member directly engaging said bottom of said groove and being compressed radially when said connector members are mated causing said spring marginal portions to slidably engage said groove sidewalls.

6. An electrical connector as set forth in claim 5 wherein:

said first and second connector members comprise a plug and a receptacle each having a shell, said plug shell being slidable into said receptacle shell when said plug and receptacle are mated;

said groove is provided in the outer surface of said plug shell; and said metallic spring is mounted over the outer periphery of said elastomeric member mounted in said groove.

7. An electrical connector as set forth in claim 5 wherein:

said connecting means has an interference fit in said groove causing said spring to be bowed outwardly before said connector members are mated.

8. An electrical connector as set forth in claim 5 wherein:

said elastomeric member carries said spring and is shaped to undergo greater resilient deflection than said spring when said connector members are mated.

9. An electrical connector as set forth in claim 5 wherein:

said elastomeric member has a relatively wide outer portion over which said spring is mounted, and a relatively narrow inner portion extending from the marginal portions of said spring to said bottom of said groove.

10. An electrical connector as set forth in claim 9 wherein:

an upstanding flange is provided on the bottom of said groove between said sidewalls thereof; and a continuous channel is formed about the inner periphery of said inner portion of said elastomeric member into which said flange extends for retaining said elastomeric member in said groove.

11. An electrical connector as set forth in claim 10 wherein:

a continuous recess is formed in the outer periphery of said outer portion of said elastomeric member about said channel forming a relatively thin section therebetween dimensioned to allow the side portions of said elastomeric member adjacent to said sides thereof to operate substantially independent of each other during mating of said connector members.

12. A plug connector member comprising:

a shell having a continuous groove formed in the outer surface thereof, said groove having a bottom and opposite sidewalls;

a substantially closed loop elastomeric member mounted in said groove and directly engaging said bottom of said groove;

a metallic spring mounted around the outer periphery of said elastomeric member and having marginal portions extending inwardly adjacent to said sidewalls, said marginal portions being spaced from said bottom of said groove;

said spring extending out of said groove beyond the outer surface of said shell; and said marginal portions of said spring wiping along said groove sidewalls and said elastomeric member undergoing radial compression when said plug connector member is engaged with a mating receptacle connector member.

13. A plug connector member as set forth in claim 12 wherein:

said spring is carried by said elastomeric member.

14. A plug connector member as set forth in claim 12 wherein:

said marginal portions of said spring are wrapped partially around the sides of said elastomeric member adjacent to said sidewalls.

15. A plug connector member as set forth in claim 12 wherein:

said spring has an interference fit in said groove causing the spring to be bowed outwardly from said groove.

16. A plug connector member as set forth in claim 12 wherein:

said elastomeric member has a relatively wide outer portion over which said spring is mounted, and a relatively narrow inner portion engaging said bottom of said groove.

17. A plug connector member as set forth in claim 16 wherein:

an upstanding flange is provided on the bottom of said groove between said sidewalls thereof; and a continuous channel is formed about the inner periphery of said inner portion of said elastomeric member into which said flange extends for retaining said elastomeric member in said groove.

18. A plug connector member as set forth in claim 17 wherein:

a continuous recess is formed in the outer periphery of said outer portion of said elastomeric member about said channel forming a relatively thin section therebetween dimensioned to allow the side portions of said elastomeric member adjacent to said sides thereof to operate substantially independent of each other during mating of said plug connector member with a receptacle connector member.

19. An electrical connecting element comprising:

an elastomeric ring;

a metallic spring mounted around the outer periphery of said ring; and said spring having marginal portions extending inwardly over the side edges of said ring terminating short of the inner periphery of said ring leaving the entire inner periphery of said ring exposed.

20. An electrical connecting element as set forth in claim 19 wherein:

said spring is secured to said ring to form an integral connection assembly.

21. An electrical connecting element as set forth in claim 19 wherein:

said spring comprises a band having alternating slots therein opening at the opposite edges of said band.

22. An electrical connecting element as set forth in claim 19 wherein:

said ring has a relatively wide outer portion and a relatively narrow inner portion; and said marginal portions of said spring extend over the sides of said outer portion.

23. An electrical connecting element as set forth in claim 22 wherein:

a continuous channel is formed in the inner periphery of said inner portion of said ring; and a continuous recess is formed in the outer periphery of said outer portion of said ring about said channel forming a relatively thin section therebetween dimensioned to allow the side portions of said ring adjacent to said sides thereof to operate substantially independent of each other.

* * * * *

UNITED STATES PATENT AND TRADEMARK OFFICE

CERTIFICATE OF CORRECTION

PATENT NO. : 4,808,126

DATED : February 28, 1989

INVENTOR(S) : Albert H. Wilson

It is certified that error appears in the above-identified patent and that said Letters Patent is hereby corrected as shown below:

Add to the drawings Figs. 5 through 12, as shown on the attached sheets.

Signed and Sealed this

Twentieth Day of February, 1990

*Attest:*

JEFFREY M. SAMUELS

*Attesting Officer*

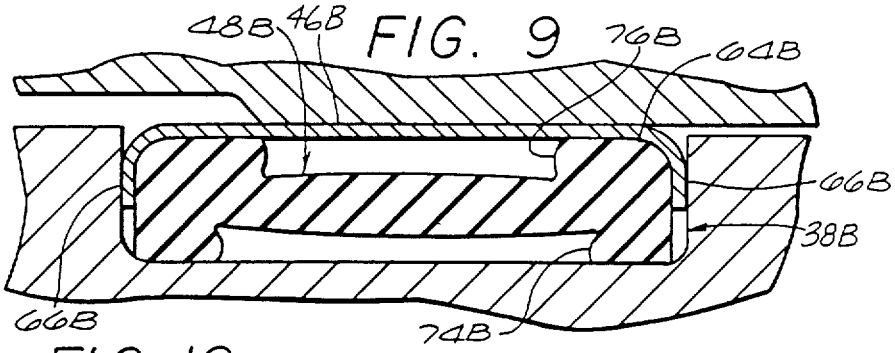
FIG. 9
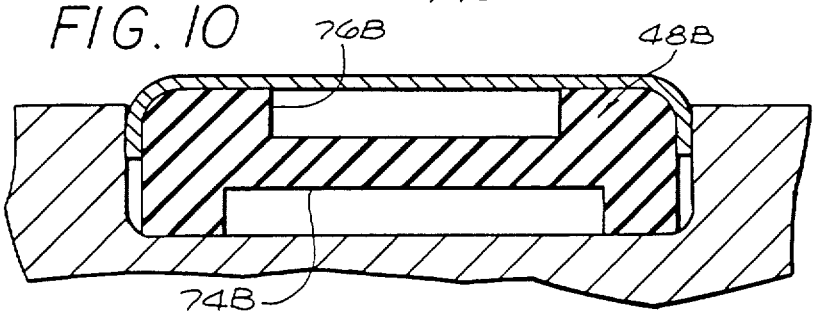
FIG. 10
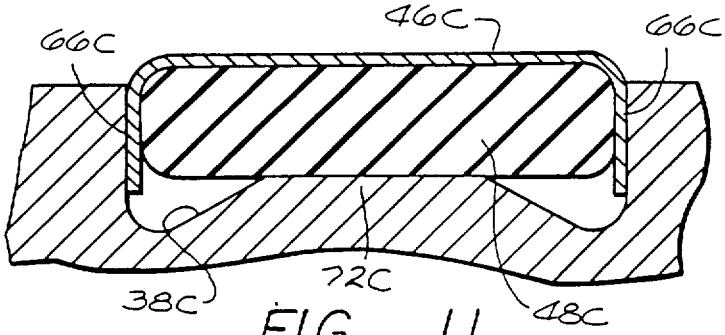
FIG. 11
FIG. 12
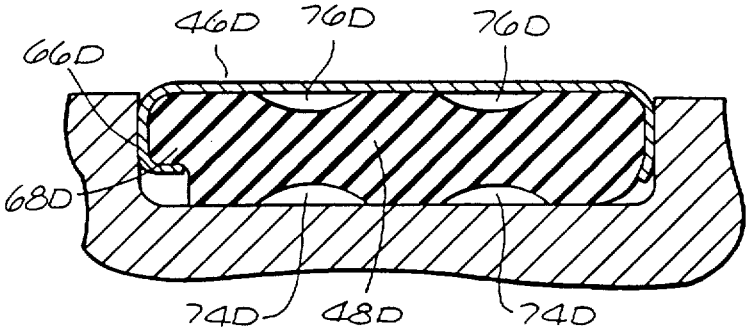

*Acting Commissioner of Patents and Trademarks*